United States Patent [19]

Weber

[11] Patent Number: 4,571,154

[45] Date of Patent: Feb. 18, 1986

[54] DEVICE FOR ADJUSTING THE TURBINE INLET FLOW CROSS-SECTION OF AN EXHAUST GAS TURBOCHARGER

[75] Inventor: Jürg Weber, Turgi, Switzerland

[73] Assignee: BBC Brown, Boveri & Company, Limited, Baden, Switzerland

[21] Appl. No.: 623,240

[22] Filed: Jun. 21, 1984

[30] Foreign Application Priority Data

Jun. 29, 1983 [CH] Switzerland ..... 3560/83

[51] Int. Cl.[4] ..... F01D 17/12

[52] U.S. Cl. ..... 415/158; 415/126; 74/105

[58] Field of Search ..... 415/126–128, 415/148, 150, 151, 157, 158; 74/103, 105; 60/602

[56] References Cited

U.S. PATENT DOCUMENTS

| | | | |
|---|---|---|---|
| 565,848 | 8/1896 | Elmer | 415/158 |
| 2,861,774 | 11/1958 | Buchi | 415/158 X |
| 3,975,911 | 8/1976 | Morgulis et al. | 415/158 X |
| 4,499,731 | 2/1985 | Moser | 415/157 X |

FOREIGN PATENT DOCUMENTS

| | | | |
|---|---|---|---|
| 134209 | 10/1979 | Japan | 415/158 |
| 277111 | 11/1951 | Switzerland | 415/148 |
| 881407 | 11/1961 | United Kingdom | 415/158 |

*Primary Examiner*—Robert E. Garrett
*Assistant Examiner*—Joseph M. Pitko
*Attorney, Agent, or Firm*—Burns, Doane, Swecker & Mathis

[57] ABSTRACT

A device for adjusting the turbine inlet flow cross-section of an exhaust gas turbocharger, wherein an adjustment element is suspended in two annular linkage levers which are located concentric to the turbine axis. The lever arm ($R_1$) of the first annular linkage lever nearer to the turbine is longer than that ($R_2$) of the second annular linkage lever. This produces a trapezoidal four bar linkage located in a plane including the turbine axis. The lengths of the lever arms ($R_1$, $R_2$), the distance between them (C) and the distance (D) between the first annular linkage lever and the point to be sealed of the adjustment element are so matched that a minimum deviation of the path of the adjustment element from translatory straight line movement of the latter is attained. The annular linkage levers and the adjustment element are preferably located in the pressure space of a pressure casing (5). An important advantage of this device consists in that more or less linear guidance of the adjustment element, which is very suitable for sealing, is attained, the low friction joints of the annular linkage levers being located in the lower temperature region.

4 Claims, 5 Drawing Figures

DEVICE FOR ADJUSTING THE TURBINE INLET FLOW CROSS-SECTION OF AN EXHAUST GAS TURBOCHARGER

FIELD OF THE INVENTION

The invention concerns exhaust gas turbines generally and more particularly, a device for adjusting the turbine inlet flow cross-section of an exhaust gas turbocharger.

BACKGROUND OF THE INVENTION

At partial load of an engine, the exhaust gas quantity is reduced, which condition leads to a reduction in the supercharge pressure if the turbine inlet flow cross-section remains unaltered. Consequently, the engine does not receive enough air, the exhaust gas temperature rises and the danger of incomplete combustion increases. In order to permit driving without these problems, it is necessary to be able to adapt the turbine inlet flow cross-section during operation. This capability leads to a more or less constant supercharge pressure and smokeless operation over the whole control range.

Such a device for adjusting the flow cross-section is the subject of Swiss patent application No. 2609/82 of Apr. 29, 1982.

In that application, an adjustable annular slide makes stepless alteration to the turbine inlet flow cross-section possible. The adjustment of the annular slide occurs, by axial displacement. The annular slide is guided in a cylindrical bore in the gas casing, a radial clearance between it and the casing being essential. In order to prevent escape of the exhaust gas, the guide of the annular slide is provided with a labyrinth seal.

Guiding a relatively short cylindrical slide in a casing bore can cause difficulties with respect to jamming of the slide. In addition, friction losses and wear phenomena are unavoidable because of the high temperature of the parts rubbing together.

OBJECT AND SUMMARY OF THE INVENTION

The object of the invention is to produce a turbine inlet flow cross-section adjustment device in which the adjustment element can be displaced as smoothly as possible and is accurately guided.

In accordance with the invention, this object is attained by an exhaust gas turbocharger having an adjustment element which is movable in an axial direction across the turbine inlet duct to control the size of the turbine inlet. Linear guidance of the adjustment element is achieved by suspending the adjustment element from two annular linkage levers which are concentric to the turbine axis, with the linkage lever nearer the turbine being longer than the second linkage lever such that a trapezoidal, four bar linkage is produced in the plane including the axis to the turbine. The lengths of the levers arms ($R_1$, $R_2$), the distance between them (C) and the distance (D) between the first annular linkage lever and the point of the adjustment element to be sealed are matched such that the path of the adjustment element departs by a minimum amount from a straight translatory movement.

The advantages obtained by the invention lie, in the main, in a quasi-translatory guidance of the adjustment element favourable to contactless sealing, the low-friction joints of the annular linkage levers being located in the lower temperature region. The annular linkage levers and the adjustment elements are located in the pressure space of a pressure casing, which arrangement provides the advantage that one single dynamically loaded sealing position relative to the environment is located at the penetration of the drive shaft. This substantially alleviates the sealing problems of the prior art. By correct dimensioning of the lever arm of the second annular linkage lever, the path of the adjustment element only has to deviate slightly from straight translatory movement of the latter.

BRIEF DESCRIPTION OF THE DRAWING

Two preferred embodiments of the invention are shown in the drawing, within.

The same parts are provided with the same reference designations in all the Figures. The flow directions of the working medium are indicated by arrows.

DETAILED DESCRIPTION OF THE PREFERRED EMBODIMENTS

Figure 1:
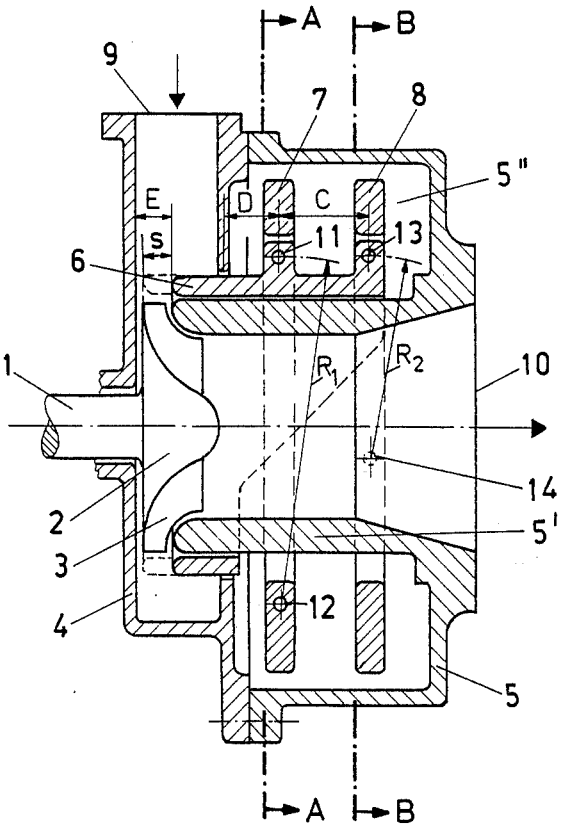
FIG. 1 is a radial turbine constructed in accordance with the present invention having a cylindrical adjustment element, in longitudinal section.

The radial turbine shown in FIG. 1 is connected via a gas inlet opening 9 to an engine exhaust gas pipe, which is not shown. The turbine shaft 1 is mounted in the turbine casing 4 and carries the turbine hub 2 provided with rotor blades 3. An axially displaceable adjustment element 6 for altering the turbine inlet flow cross-section is located upstream of the radial turbine. The end surface of the adjustment element 6 protruding into the turbine flow duct is rounded to conform with the flow. The fully open position of the adjustment element 6 corresponds to the maximum width E of the turbine inlet flow duct.

The maximum axial displacement S of the adjustment element 6 is determined by the width of the motor control range. On this point, it is important that the reduction of the turbine inlet flow cross-section should be so matched that the absolute gas inlet velocity into the turbine remains approximately constant over the whole rotational speed range.

In accordance with the invention, the adjustment element 6 is suspended in two annular linkage levers 7, 8 located concentrically to the turbine axis. The lever arm $R_1$ of the first annular linkage lever 7 nearer to the turbine is longer than the lever arm $R_2$ of the second annular linkage lever 8. This arrangement provides a trapezoidal four bar linkage located in a plane including the turbine axis. The lengths of the lever arms $R_1$ and $R_2$, the axial distance C between them and the distance D between the first annular linkage lever 7 and the point of the adjustment element 6 to be sealed are so matched that the path of the adjustment element 6 departs by a minimum amount from the straight translatory movement of the latter. A pressure casing 5, which has a gas outlet opening 10, is attached to the turbine casing 4. The rotationally symmetrical inner part 5' of the pressure casing 5 is designed as a hollow, coaxially located cylinder. Its end surface facing towards the turbine is profiled to conform with the flow and determines the width E of the turbine inlet flow duct. The pressure casing 5 includes a pressure space 5''.

The annular linkage levers 7, 8 and the adjustment element 6 are located in the pressure space 5'' of the pressure casing 5, where they are located in the lower temperature region.

This arrangement of the annular linkage levers 7, 8 and the adjustment element 6 in the pressure space 5'' of the pressure casing 5 has the advantage that the penetrations to be sealed between the turbine flow duct, which is under gas pressure, and the atmosphere are reduced to a minimum. Only the bearing of the linkage pin 14 has to be sealed. This task is undertaken by a simple shaft seal 16.

The lever arm $R_2$ of the annular linkage lever 8 can preferably be determined as a function of the other factors of influence, as follows:

$$R_2 = \frac{1}{2}\left[\frac{D\cdot\left(\frac{S}{2}\right)^2}{(C+D)\cdot\left(R_1-\sqrt{R_1^2-\left(\frac{S}{2}\right)^2}\right)} + \frac{C+D}{D}\left(R_1-\sqrt{R_1^2-\left(\frac{S}{2}\right)^2}\right)\right]$$

The formula is approximately valid for:

$$\left[R_1-\sqrt{R_1^2-\left(\frac{S}{2}\right)^2}\right]\frac{1}{D} \leqq 0{,}05$$

The symbols have the following significance:

D Axial distance between the annular linkage lever 7 and the point to the sealed.

S Maximum axial displacement of the adjustment element 6

C Axial distance between the annular linkage levers $R_1$ Lever arm of the annular linkage lever 7

The cylindrical surface of the adjustment element 6 opening inwards is displaced along the external cylindrical surface of the inner part 5' of the pressure casing 5 without contact occurring. In a similarly contactless manner, the cylindrical surface of the adjustment element 6 opening outwards is displaced along the cylindrical surface of the axial bore located in the turbine casing 4. The radial gap between the inner part 5' of the pressure casing 5 and the adjustment element 6 and the radial gap between the turbine casing 4 and the adjustment element 6 must be as small as possible because otherwise the pressure gradients present in the peripheral direction of the turbine inlet flow duct and the pressure differences across the adjustment element 6 would cause flow losses and intense eddying of the engine exhaust gas in the pressure space 5''. The eddying of the hot engine exhaust gas in the pressure space 5'' could adversely affect the action of the joints in the trapezoidal four bar linkage.

Figure 2:
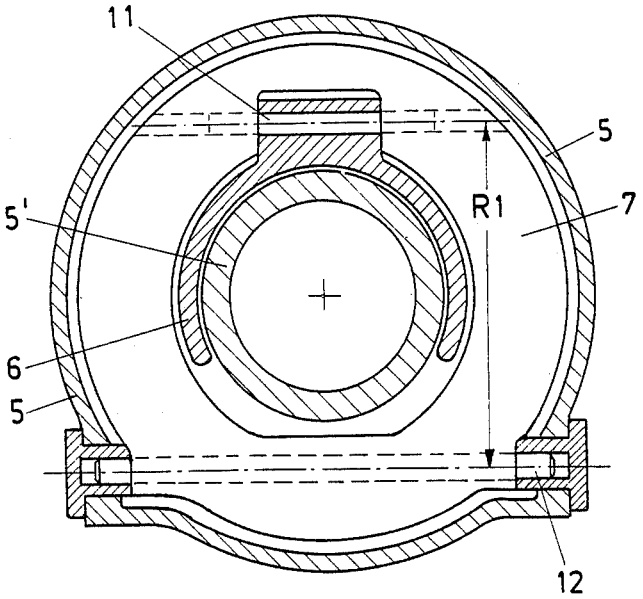
FIG. 2 is a cross-section along the line A—A in FIG. 1.

In the cross-section shown in FIG. 2, the longer annular linkage lever 7 is shown. This annular linkage lever 7 is supported underneath by means of a link pin 12 in the pressure casing 5. The adjustment element 6 is rotatably suspended at the top by means of a link pin 11 on the annular linkage lever 7.

Figure 3:
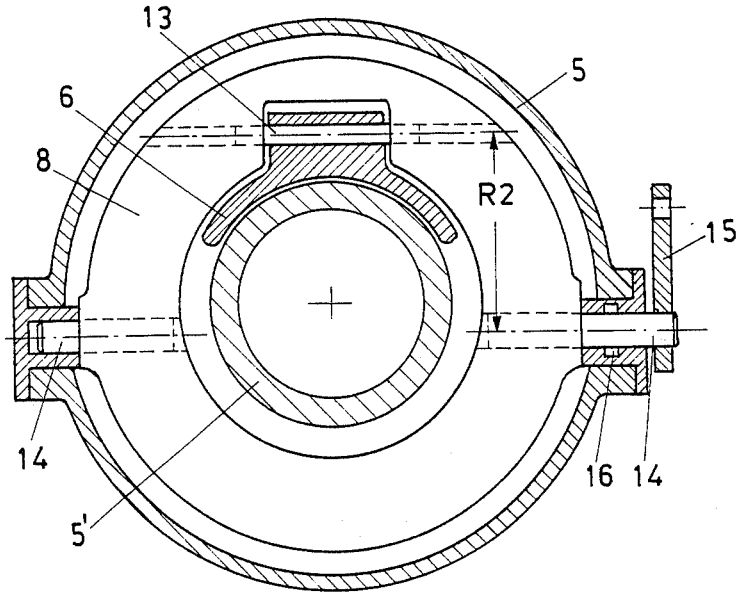
FIG. 3 is a cross-section along the line B—B in FIG. 1.

FIG. 3 shows a cross-section along the line B—B in FIG. 1. The second annular linkage lever 8 is supported here, again in the pressure casing 5, by a two-part linkage pin 14, on which a drive lever 15 is rigidly located. The linkage pin 14 has a shaft seal 16 in its bearing on the side of the actuating lever 15. The adjustment element 6 is rotatably suspended at the top on the annular linkage lever 8 by means of a linkage pin 13.

The manner of operation of the device is as follows. At full engine load, the adjustment element 6 is in its open position, as is shown in FIG. 1. If the load on the engine is reduced, the exhaust gas pressure upstream of the turbine is reduced. The adjustment element 6 is now displaced automatically or manually into the flow duct, causing the distance E between the adjustment element 6 and the casing 4 and hence the turbine inlet flow cross-section to be reduced. The motor exhaust gas pressure can, for example, be used as the control quantity in the case of automatic control of the displacement element 6.

The displacement of the adjustment element 6 at minimum load on the engine is shown dotted in FIG. 1 and indicated by S.

The mechanism for operating the adjustment element 6 is a trapezoidal spatial four bar linkage whose centres of rotation are formed by two linkage pins 12, 14 located in the casing 5 and solid with the casing and by pins 11, 13, of which one is located in each of the two annular linkage levers 7, 8. Due to the pivoting of the actuating lever 15, which is solidly connected to the pin 14, the latter being solidly connected to the annular linkage lever 8, the annular linkage lever 8 now pivots the pin 14 by the same pivoting angle as the actuating lever 15. The pin 13 then moves along a circular arc path with a radius $R_2$ around the linkage pin 14. This movement is transmitted to the adjustment element 6, the latter being displaced in an approximately axial direction. Since the adjustment element 6 has a pin joint suspension by means of the pin 11 in the annular linkage lever 7, the latter also pivots in the same direction as the annular linkage lever 8 but by a somewhat smaller angle, the linkage pin 11 moving along a circular arc path with a radius $R_1$ about the linkage pin 12. Since the radius $R_2$ is smaller than $R_1$, the end surface of the adjustment element 6 facing towards the turbine is raised upwards out of its falling orbit during a pivoting movement of the two annular linkage levers 7, 8 in the direction of the turbine rotor 2, 3; in consequence, the movement of the adjustment element 6 only deviates slightly from a pure translation. The displacement of the adjustment element can therefore be considered as being more or less a straight line.

Figure 4:
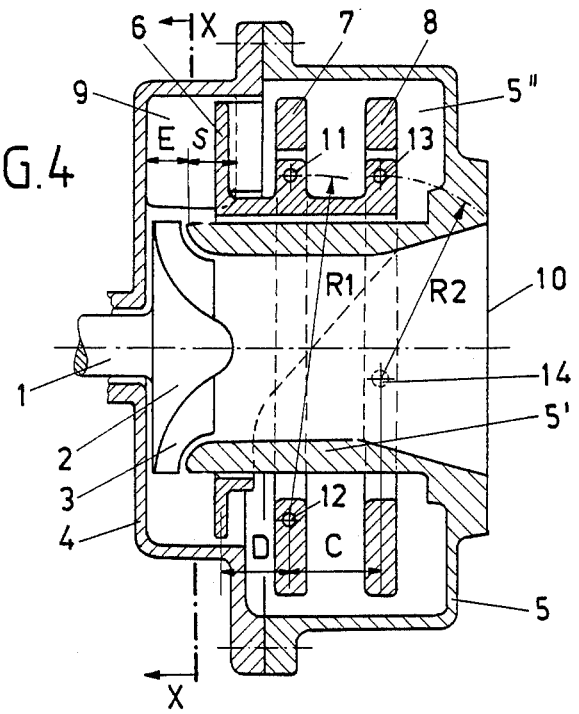
FIG. 4 is a another radial turbine constructed in accordance with the present invention with an axially adjustable boundary wall of the volute-shaped inlet flow duct.
Figure 5:
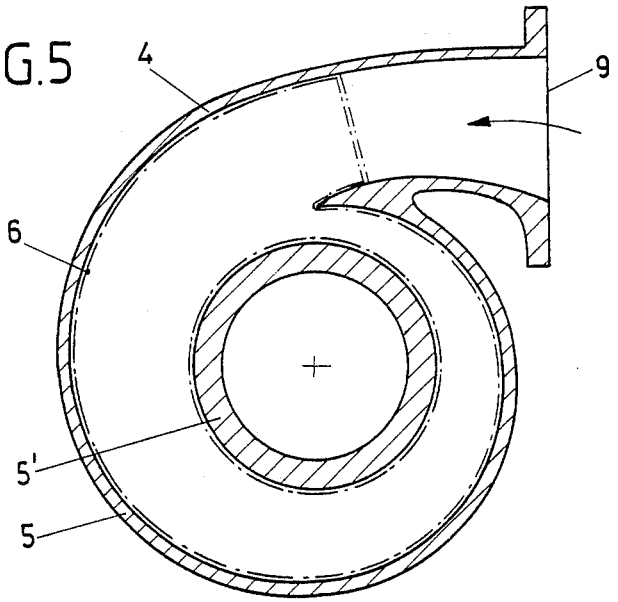
FIG. 5 is a cross-section along the line X—X in FIG. 4.

The radial turbine in accordance with FIG. 4 differs from that in accordance with FIG. 1 in that the adjustment element 6 is embodied in the form of a displaceable boundary wall of the volute-shaped flow duct located in the turbine casing 4. The shape of the adjustment element 6 matching the volute-shaped flow duct is drawn chain-dotted in FIG. 5. In this case, the adjustment mechanism is fully identical with that of FIG. 1.

The advantage of the invention is particularly to be seen in that accurate and low-friction, quasi-translatory guidance of the adjustment element 6 with contactless sealing is provided, in which sealing arrangement the wear phenomena and operating difficulties are substantially eliminated and the life of the device positively affected.

The invention is not, of course, limited to the matter shown and described in the drawing. It also includes other types of turbines which, for example, are provided with a partially radial flow turbine apparatus and with an adjustment element displaceable in the axial direction.

Accordingly, it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. In a device for adjusting the turbine inlet flow cross-section of an exhaust gas turbocharger consisting essentially of an adjustment element movable in the axial direction by an amount (S), which adjustment element is located in the turbine flow duct upstream of the rotor blades, and of a mechanism for actuating the adjustment element, the improvement comprising the adjustment element being suspended by two annular linkage levers located concentric to the turbine axis, the lever arm ($R_1$) of the first annular linkage lever nearer to the turbine being longer than that ($R_2$) of the second annular linkage lever and that, by this means, a trapezoidal four bar linkage located in a plane including the turbine axis is produced, the lengths of the lever arms ($R_1$,$R_2$), the axial distance between them (C) and the distance (D) between the first annular linkage lever and the point of the adjustment element to be sealed being so matched that the path of the adjustment element departs minimally from the straight translatory movement of the latter.

2. The device in accordance with claim 1, wherein the annular linkage levers and the adjustment element are located in a pressure space of a pressure casing.

3. Device according to claim 2, characterised in that the lever arm ($R_2$) of the annular linkage lever (8) is determined as a function of other factors of influence, as follows:

$$R_2 = \frac{1}{2}\left[\frac{D\cdot\left(\frac{S}{2}\right)^2}{(C+D)\cdot\left(R_1-\sqrt{R_1^2-\left(\frac{S}{2}\right)^2}\right)} + \frac{C+D}{D}\left(R_1-\sqrt{R_1^2-\left(\frac{S}{2}\right)^2}\right)\right],$$

the formula being approximately valid for:

$$\left[R_1-\sqrt{R_1^2-\left(\frac{S}{2}\right)^2}\right]\frac{1}{D} \leqq 0{,}05$$

4. The device according to claim 1, wherein the lever arm ($R_2$) of the annular linkage lever is determined as follows:

$$R_2 = \frac{1}{2}\left[\frac{D\cdot\left(\frac{S}{2}\right)^2}{(C+D)\cdot\left(R_1-\sqrt{R_1^2-\left(\frac{S}{2}\right)^2}\right)} + \frac{C+D}{D}\left(R_1-\sqrt{R_1^2-\left(\frac{S}{2}\right)^2}\right)\right],$$

the formula being approximately valid for:

$$\left[R_1-\sqrt{R_1^2-\left(\frac{S}{2}\right)^2}\right]\frac{1}{D} \leqq 0{,}05.$$

* * * * *